US005389231A

United States Patent [19]

Brander et al.

[11] Patent Number: 5,389,231

[45] Date of Patent: Feb. 14, 1995

[54] CATALYTIC CRACKING PROCESS AND APPARATUS THEREFOR

[75] Inventors: John F. R. Brander, Baton Rouge, La.; Todd R. Steffens, Randolph, N.J.

[73] Assignee: Exxon Research and Engineering Company, Florham Park, N.J.

[21] Appl. No.: 944,598

[22] Filed: Sep. 14, 1992

Related U.S. Application Data

[63] Continuation-in-part of Ser. No. 664,723, Mar. 5, 1991, abandoned.

[51] Int. Cl.[6] ..... C10G 11/00; C10G 35/10

[52] U.S. Cl. ..... 208/113; 208/150; 208/160; 208/153; 208/159

[58] Field of Search ..... 208/113, 160, 159, 150, 208/153

[56] References Cited

U.S. PATENT DOCUMENTS

| | | | |
|---|---|---|---|
| 3,351,548 | 11/1967 | Payne et al. | 208/153 |
| 3,392,110 | 7/1968 | Payne | 208/160 |
| 4,197,418 | 4/1980 | Lee et al. | 208/120 |
| 4,419,221 | 12/1983 | Castagnos, Jr. et al. | 208/113 |
| 4,789,458 | 12/1988 | Haddad et al. | 208/113 |
| 4,820,404 | 4/1989 | Owen | 208/113 |
| 4,822,761 | 4/1989 | Walters et al. | 208/113 |
| 4,851,374 | 7/1989 | Yan et al. | 208/113 |
| 4,859,315 | 8/1989 | Bartholic | 208/113 |
| 4,917,790 | 4/1990 | Owen | 208/159 |
| 4,960,503 | 10/1990 | Haun et al. | 208/113 |
| 4,971,681 | 11/1990 | Harandi et al. | 208/113 |
| 4,973,398 | 11/1990 | Pappal et al. | 208/113 |
| 4,973,452 | 11/1990 | Owen | 208/150 |
| 5,032,251 | 7/1991 | Owen et al. | 208/158 |
| 5,062,945 | 11/1991 | Pappal et al. | 208/113 |
| 5,128,109 | 7/1992 | Owen | 208/153 |
| 5,160,426 | 11/1992 | Avidan | 208/159 |

*Primary Examiner*—Helane Myers
*Attorney, Agent, or Firm*—Roy J. Oh

[57] ABSTRACT

A catalytic cracking process and apparatus wherein hot regenerated catalyst particles from the dense phase of the regenerator are passed through a heat exchanger in indirect heat exchange with stripped catalyst particles whereby the former are cooled and the latter are heated. The regenerated catalyst which contacts the feed is thus cooler than it would otherwise be, and there is a reduction in thermal cracking. The stripped catalyst entering the regenerator is hotter than it would otherwise be thereby improving the efficacy of the regeneration step.

11 Claims, 2 Drawing Sheets

CATALYTIC CRACKING PROCESS AND APPARATUS THEREFOR

CROSS REFERENCE TO RELATED APPLICATIONS

This application is a continuation-in-part application of application Ser. No. 664,723 filed Mar. 5, 1991, now abandoned.

BACKGROUND OF THE INVENTION

1. Field of the Invention

The present invention relates to a catalytic cracking process and apparatus therefor.

2. Description of Related Art

In conventional catalytic cracking, particles of cracking catalyst are contacted in a reaction zone with a hydrocarbon feed at catalyst temperatures which are sufficiently high to cause a reasonable percentage conversion of the feed with an acceptable amount of by-product such as coke and normally gaseous products. The coke is deposited on the catalyst particles and is removed therefrom by contacting the coked catalyst particles with an oxygen-containing gas in a regenerator whereby coke is removed by exothermic oxidation which heats the catalyst particles as they are thus regenerated. The heated regenerated particles are contacted with further amounts of hydrocarbon feed.

A factor determining the temperature of the heated regenerated particles is the amount of coke-removal in the regenerator. If the feed is of the type which causes relatively large coke deposits, the oxidation of the coke can result in heated regenerated catalyst particles whose temperature is so high that upon contact with the feed, coke (and light hydrocarbon gases) are formed as by-products in amounts which are significantly detrimental to the economics of the catalytic cracking operation. It is accepted that coke must be removed from used catalyst particles in order to regenerate the catalytic properties of the particles. It will be appreciated from the foregoing that in catalyst cracking operations wherein the heat produced by coke oxidation results in excessively high regenerated catalyst temperatures, there can be detriment to the economics of the catalytic cracking operation.

It is known to cool catalyst particles circulating in a fluidized catalytic cracking unit ("FCCU"). For example, U.S. Pat. Nos. 4,820,404 and 4,917,790 disclose cooling spent or used catalyst from the catalyst stripper by indirect heat exchange with a cooling fluid to moderate the temperature in part of the regenerator.

U.S. Pat. No. 4,971,681 discloses the use of flue gas from the cyclone section of the regenerator to indirectly heat the spent catalyst in the stripping zone of the reactor. The regenerator flue gas contains a dilute concentration of catalyst particles in it. The flue gas contains carbon monoxide which when mixed with oxygen burns to carbon dioxide inside the heat exchanger positioned in the catalyst stripper section of the reactor.

U.S. Pat. No. 5,062,945 discloses the use of hot regenerator flue gas to heat the catalyst stripper section. This patent does not recognize the use of regenerated catalyst from the dense catalyst phase of the regenerator to heat the spent catalyst for stripping.

SUMMARY OF THE INVENTION

In a catalytic cracking process comprising the steps of contacting a hydrogen feed with particles of active hydrocarbon cracking catalyst under hydrocarbon-cracking conditions in a reaction zone, separately recovering from the reaction zone (a) vaporous cracked hydrocarbon products and (b) used catalyst particles, contacting the used catalyst particles with a stripping medium in a stripping zone to recover from the used catalyst particles hydrocarbon material associated therewith, passing stripped used catalyst particles from the stripping zone to a regeneration zone wherein the stripped used particles are contacted with an oxygen-containing gas to remove hydrocarbonaceous material associated therewith in a exothermic oxidation reaction which regenerates and heats the catalyst particles, and circulating the heated regenerated catalyst particles to the reaction zone for contact with further amounts of hydrocarbon feed; the improvement wherein at least some of the hot regenerated catalyst particles from the dense catalyst phase of the regenerator are passed in dense phase flow in indirect heat exchange relationship in a heat exchanger external to the stripping zone with at least some used catalyst particles from the stripping zone before contacting hydrocarbon feed in the reaction zone whereby the temperature of the regenerated catalyst particles contacting the feed is reduced and the temperature of the said used catalyst particles is increased.

DETAILED DESCRIPTION OF THE INVENTION

The present invention provides, in one aspect, a catalytic cracking process wherein at least some of the hot regenerated catalyst particles from the dense catalyst phase of the regenerator are passed in indirect heat exchange relationship with at least some used catalyst particles from the stripping zone before contacting hydrocarbon feed in the reaction zone whereby the temperature of the regenerated catalyst particles contacting the feed is reduced and the temperature of the said used catalyst particles is increased.

Preferably, the used catalyst particles from the stripping zone which are passed to the indirect heat exchange step are stripped used catalyst particles from one region (e.g., a downstream region) of the stripping zone.

At least some heated used catalyst particles from the indirect heat exchange step may be returned to the stripping zone to increase the average or mean temperature of particles in the stripping zone, and any remaining heated used catalyst particles may be passed to the regeneration zone. Heated used particles from the indirect heat exchange step may be returned to the same or another region (e.g., an upstream region) of the stripping zone. The temperature of the heated used particles from the indirect heat exchange step may be in the range of from 490° to 600° C.

The average or mean temperature of particles in the stripping zone may be in the range of from 490° to 650° C.

The used catalyst particles and/or regenerated catalyst particles may be maintained in a fluidized state while in the said indirect heat transfer relationship.

The catalyst particles may be fluidized, during the said indirect heat exchange step, by a fluidizing gas containing steam and/or hydrogen and/or light hydrocarbons. The fluidizing gas may be separated and recovered from the catalyst particles after the said indirect heat exchange step.

The fluidizing gas may be at a temperature up to 600° C. (e.g., up to 540° C.) before and/or during contact with catalyst particles in the said indirect heat exchange step.

A benefit of employing the fluidizing gas is that the used catalyst is further stripped of hydrocarbon material thereby.

In another aspect, the present invention provides a fluid cracking unit ("FCCU") comprising a reaction zone wherein a hydrocarbon feed is contacted with particles of active hydrocarbon-cracking catalyst under hydrocarbon cracking conditions, separating means for separately recovering from the reaction zone (a) vaporous cracked hydrocarbon products, and (b) used catalyst particles, a stripping zone arranged for receiving used catalyst from the separating means and wherein used catalyst is contacted with a stripping fluid, a regeneration zone connected for receiving stripped catalyst particles and wherein the stripped particles are contacted with an oxygen-containing gas to remove hydrocarbonaceous deposits therefrom in an exothermic reaction which regenerates and heats the catalyst particles, a conduit for circulating heated regenerated catalyst particles from the regeneration zone to the reaction zone for contact with hydrocarbon feed, an indirect heat exchanger connected to pass at least some heated regenerated catalyst particles from the dense catalyst phase of the regenerator in indirect heat-transfer relationship with used particles from the stripping zone whereby to cool the former and heat the latter during operation, and a conduit for circulating cooled regenerated catalyst particles from the said heat exchanger to the reaction zone.

The unit may comprise a conduit for circulating used catalyst particles from one region (e.g., a discharge or downstream region) of the stripping zone to the heat exchanger.

The unit may comprise conduit means for circulating used catalyst particles from the heat exchanger to the same or another region (e.g., an upstream region) of the stripping zone and/or to the regenerating zone.

The said heat exchanger may be of the shell-and-tube type and there may be provided means for introducing a fluidizing gas comprising steam and/or hydrogen and/or light hydrocarbons into the shell side and/or the tube side of the heat exchanger.

The unit may comprise means for separately recovering used catalyst particles and vapour-phase materials from the shell-and-tube heat exchanger.

The invention is now further described with reference to embodiments thereof, given by way of non-limitative illustration, and with reference to the accompanying diagrammatic drawings, in which:

BRIEF DESCRIPTION OF THE DRAWINGS

In the drawings, like parts are given like reference numbers.

Figure 1:
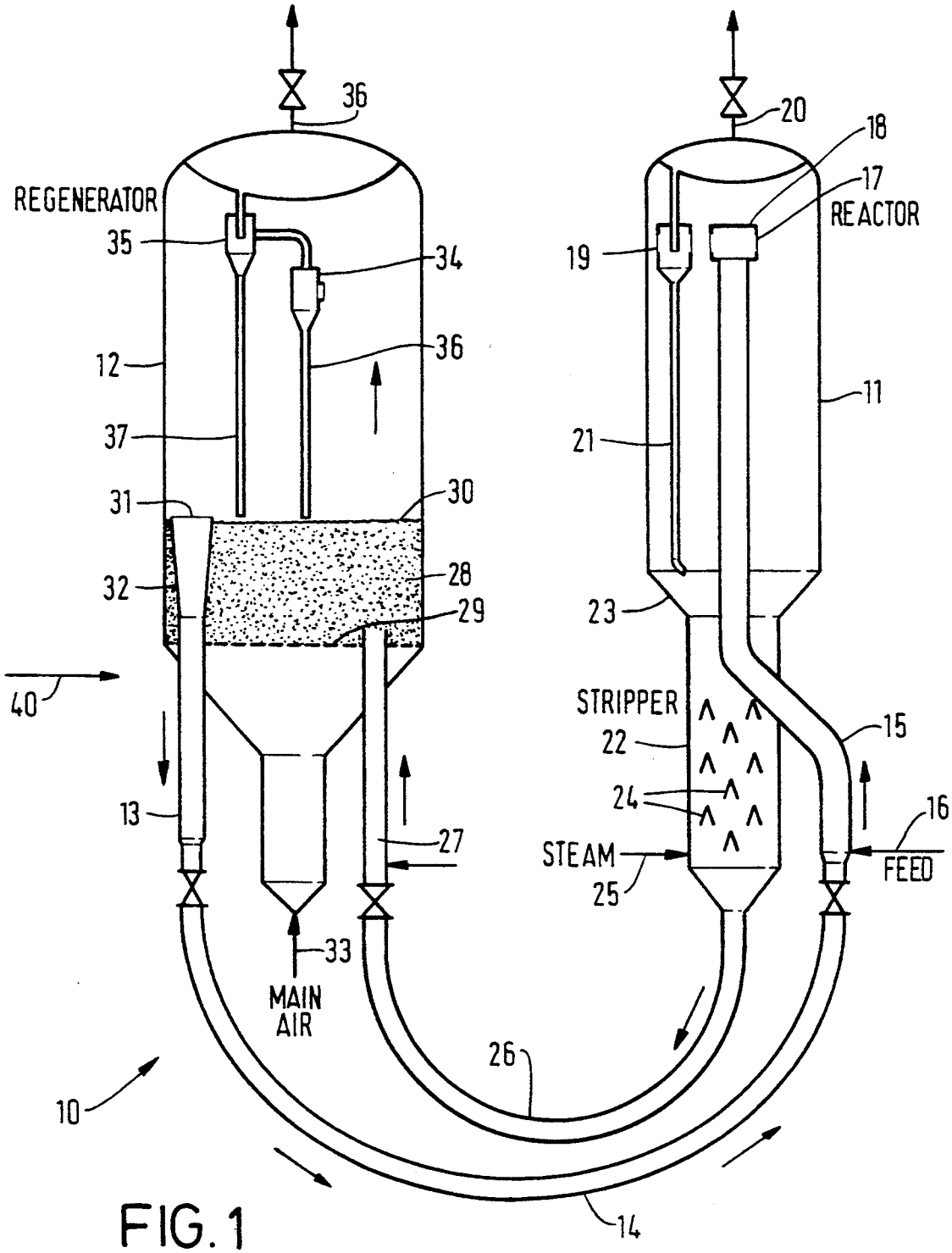
FIG. 1 shows, schematically, the principal parts of one type of fluidized catalytic cracking unit ("FCCU")

Reference is first made to FIG. 1 wherein the FCCU, generally indicated by 10, comprises a reactor vessel 11 and a regenerator vessel 12.

Hot regenerated particles of cracking catalyst are recovered from the regenerator vessel 12 in a downcomer 13 which is connected at its bottom end to the top of one upstanding arm of a U-shaped conduit 14, the top of the other arm of which is connected to a riser 15. The riser 15 is a generally vertical tube which may have, as is shown in FIG. 1, an inclined section so that the part of the riser 15 surmounting the inclined section lies within the reactor 11.

The hydrocarbon feed which is to be cracked is passed from a feed line 16 into the interior of the bottom end of the riser 15 via one or more injectors (not shown) so as to furnish good dispersion of the feed with the hot regenerated catalyst particles.

The contacting of the feed with the hot regenerated catalyst results in the generation of hydrocarbon vapours which reduce the density of the catalyst/hydrocarbon mixture in the riser 15 to a lower density than the catalyst density in the downcomer 13, and as a result of the difference in weight between the catalyst masses in the downcomer 13 and the riser 15, a circulation of catalyst from the downcomer 13 to the riser 15 through the conduit 14 is promoted and maintained. The catalyst flow may be assisted by the injection of a fluidizing gas, usually steam, at suitable injection points (not shown) along the length of the conduit 14 in a manner which is well-known to those skilled in the art.

The mixture of catalyst and cracked hydrocarbon products discharges from the top of the riser 15, within the reactor vessel 11, via substantially horizontal orifices 17 below a cap 18 at the top end of the riser 15 and used catalyst particles tend to sink within the reactor vessel 11 and thereby separate from vapours. Vapours pass into one or more cyclone separators 19 wherein entrained used catalyst particles are separated, and substantially solids-free vapour-phase cracked products are recovered via product line 20. Used catalyst particles which are separated by the cyclone(s) 19 pass to the bottom of the reactor vessel via dipleg 21 where they add to used catalyst particles which have already separated from vapours on discharge from the orifices 17 at the top end of the riser 15.

The used catalyst particles which accumulate at the bottom of the reactor vessel are associated in various ways with hydrocarbon materials. Some of the associated hydrocarbon materials are entrained between used catalyst particles, and some associated hydrocarbon material is sorbed on or in the used catalyst particles. Since the hydrocarbon materials thus associated can represent an appreciable proportion of the total hydrocarbon feed input, it is common practice to subject the used catalyst particles to a hydrocarbon-stripping operation to remove hydrocarbon materials therefrom.

The stripping operation is performed in a stripper 22. The stripper 22 comprises a generally cylindrical vessel having its top end open to the frusto-conical bottom end 23 of the reactor vessel 11 so that catalyst particles are received in the stripper 22 from the reactor vessel.

Within the stripper 22 are mounted baffles, in the form of arrays of metal "sheds" 24 which resemble the pitched roofs of houses. The purpose of the sheds 24 is to disperse catalyst particles uniformly across the width of the stripper 22 and to minimize internal refluxing or "backmixing" of catalyst particles within the stripper.

A stripping fluid, usually steam, is passed into the bottom region of the stripper 22 from a suitable pipe 25, and the steam passes upwardly in counterflow to the downflowing catalyst particles, thereby separating therefrom hydrocarbon materials which are entrained between the particles and also desorbing some of the sorbed hydrocarbon material.

Steam and separated hydrocarbon material pass into the reactor vessel and cyclone separator(s) 19, and are recovered in the product line 20.

Stripped catalyst particles are recovered from the frustoconical bottom of the stripper 22 in an upright arm of a U-shaped conduit 26 which is generally similar to the U-shaped conduit 14. The other upright arm 27 of the conduit 26 terminates at its open upper end in a bed 28 of catalyst undergoing regeneration. The bed is supported on a gas distributor 29 and extends upwardly to a level 30 which is determined, at least in part, by the level of the top of an exit weir 31 formed by the top of a funnel 32 which is connected at its bottom to the top of the downcomer 13.

A fluidizing gas, such as air, is passed into the bottom region of the upright arm 27 from a gas line 33 to fluidize and reduce the density of catalyst in the arm 27 so that the weight of catalyst in the opposite arm of conduit 26 causes catalyst to flow through conduit 26 into the bed 28.

Catalyst in the bed 28 is regenerated by passing air or other oxygen-containing gas into the bottom of the bed 28 via perforations in the distributor 29. The air is passed from air conduit 39 into the bed 28 via the distributor 29.

Combustible hydrocarbonaceous material ("coke") on the used, stripped catalyst particles in the bed 28 is at least partly removed by exothermic oxidation in the bed 28 whereby the regenerated catalyst particles overflowing the weir 31 for return to the riser 16 have a raised temperature compared to the temperature of the used stripped catalyst particles entering the bed via riser 27 from the stripper. The raised temperature of the regenerated catalyst particles represents added heat which is useful for the endothermic vaporisation and cracking of the hydrocarbon feed introduced from feed line 16.

Spent regeneration gas and entrained catalyst leave the top of the bed 28 and pass via a primary cyclone separator 34 and a secondary cyclone separator 35 before being recovered in flue gas line 36 for disposal. Entrained catalyst particles which are separated by the cyclones 34 and 35 are returned to the bed 28 by respective diplegs 36 and 37.

Figure 2:
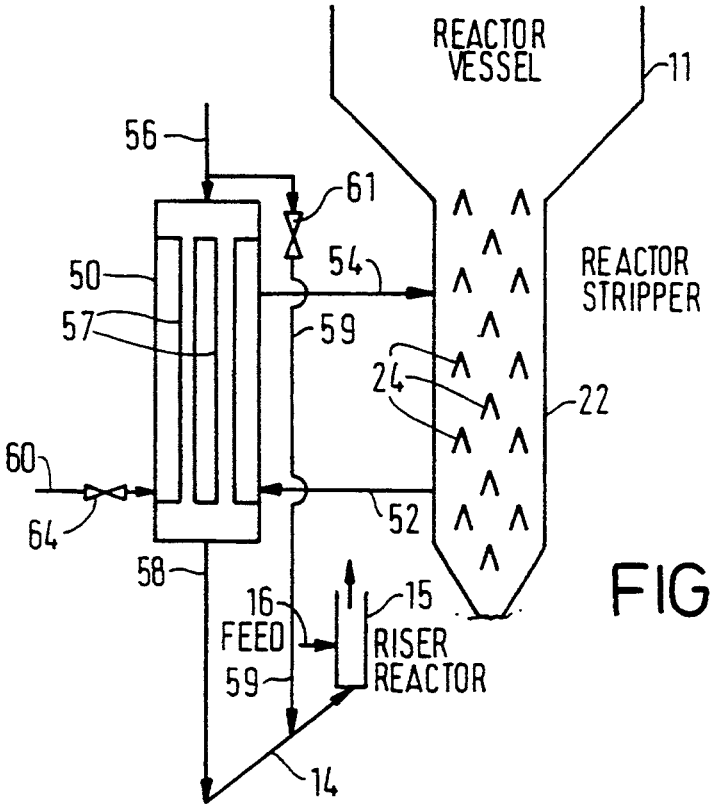
FIG. 2 shows some of the parts shown in FIG. 1 with adaptions in accordance with one embodiment of the invention.

Reference is now made to FIG. 2 of the drawings. FIG. 2 might be regarded as a schematic view of the FCCU 10 of FIG. 1 as seen when looking to the lower part of the reactor vessel 11 in the direction of the arrow 40 in FIG. 1.

In FIG. 2, there is depicted diagrammatically an indirect heat exchanger 50. The heat exchanger 50 may be of the shell-and-tube type.

In the heat exchanger 50, at least some of the hot regenerated catalyst from the dense catalyst phase of the regenerator is passed in indirect heat exchange with used partially or fully stripped catalyst withdrawn from the downstream end of the stripper 22 whereby the regenerated catalyst is cooled and the used catalyst is heated. The cooled regenerated catalyst is passed to the riser 15 for use in cracking fresh hydrocarbon feed and the heated used catalyst is returned to the upstream end of the stripper 22 wherein it mixes with and heats used catalyst in the stripper. Hot regenerated catalyst which is passed through the heat exchanger 50 is passed via line 59 directly into line 14.

The amount of regenerated catalyst passed through the heat exchanger 50 may be up to 100% (e.g., from 10 to 25%) of the catalyst circulation rate. The amount of used catalyst passed through the heat exchanger 50 may be up to 40% (e.g. 10 to 20%) of the used catalyst circulation rate. The actual relative proportions of regenerated to used catalyst passing through the heat exchanger 50 is regulated so as to depend on the operating conditions in the reactor and regenerator, but should be sufficient to raise the temperature of the catalyst in the stripper by an amount in the range of from 10° to 40° C. (e.g. from 15° to 30° C.), and to reduce the temperature of regenerated catalyst passing to the riser 15 by an amount which will reduce thermal cracking of the feed to an acceptable level while maintaining catalytic cracking and conversion levels economically high. For a typical hydrocarbon feed, the reduction in temperature of the catalyst particles as a result of their heat exchange with used catalyst particles in the heat exchanger 50 will usually be in the range of from 10° to 30° C. (e.g. 15° to 25° C., for example about 20° C.). The regulation of the relative amounts of hot regenerated catalyst passing through the heat exchanger 50 and via the line 59 is effected by a valve such as valve 61 in line 59. For heavier feeds, the temperature reduction caused by heat transfer in the heat exchanger 50 may be increased in order to reduce the amount of carbon and light gas by-product production. An increased amount of heat transfer in the heat exchanger 50 from hot regenerated catalyst to used catalyst may be effected by increasing the rate of flow of used catalyst through the heat exchanger 50. The rate of flow of used catalyst through the heat exchanger 50 may be controlled by regulating the rate at which a fluidizing gas is passed into the bottom of the shell side of the heat exchanger 50 from line 60. The fluidizing gas may be any gas which compatible with the catalyst particles. Suitable gas may be virtually any by-product gas from refinery operations, e.g., catalytic cracker gas and/or hydrogen-containing gas and/or steam. A fluidizing gas may be passed into the heat exchanger 50 on the tube side thereof. The fluidizing gas may be passed into the tube side at any convenient location or region, e.g., at the bottom thereof, so as to fluidize catalyst particles passing via the tubes 57 of the tube side. Such fluidization tends to enhance The movement of catalyst particles through the tubes 57 and also to enhance heat transfer from catalyst particles in the tubes 57 to catalyst particles in the shell side of the heat exchanger 50. Any fluidization gas may be employed which compatible with the regenerated catalyst and not detrimental to its physical and chemical properties. A suitable fluidization gas may contain hydrogen and/or catalytic cracker gas and/or steam, and a suitable fluidizing gas may be formulated and/or selected by a person skilled in the art. The various ways in which a suitable fluidizing gas may be introduced into the tube side of the heat exchanger 50 will be appreciated, understood, known and implemented by a person skilled in the art, and is therefore not shown in the drawings. The rate of introduction of fluidizing gas into the heat exchanger is regulated by a valve 64 in line 60, although other modes of regulation will occur to those skilled in the art.

The increased temperature in the stripper enhances and facilitates the stripping of entrained and sorbed hydrocarbon material from the used catalyst passing through the stripper. The circulation of heated used catalyst to the stripper does not significantly increase the number of sites at which stripped hydrocarbon material can be sorbed, and thus does not significantly reduce the additional amount of hydrocarbon material stripped from catalyst passing through the stripper as a result of the increased operating temperature in the stripper.

The use of indirect heat exchange heating of used catalyst also avoids the drawback of direct heat exchange by mixing used and regenerated catalyst whereby the amount of catalyst circulated to the regenerator (i.e., used plus regenerated catalyst) is increased so that less regenerated catalyst can be supplied to the riser and reactor, thereby reducing the catalyst:feed hydrocarbon ratio and thereby reducing the intensity of the catalytic reactions in the riser-reactor. In FCCUs which are operated at or near their maximum throughputs, a reduction in conversion intensity is reflected in reduced cracked product recovery.

Referring again to FIG. 2, it will be seen that stripped used catalyst passes from the downstream end of the stripper 22 to the bottom of the shell side of the heat exchanger 50 via one or more conduits 52. Heated used catalyst passes from the top of the shell side of the heat exchanger 50 to the upstream end of the stripper 22 via one or more return conduits 54. Hot regenerated catalyst from the dense catalyst phase of the regenerator (not shown) enters the top of the tube side of the heat exchanger 50 from line 56, passes downwardly through heat exchange tubes 57 in indirect heat exchange relationship with the upwardly passing used catalyst, and leaves the bottom of the tube side of the heat exchanger 50 via line 58 at a lower temperature. The cooled regenerated catalyst is passed, either alone or mixed with hot regenerated catalyst direct from the regenerator 12, into the base of the riser 15.

Although the used catalyst is depicted as being on the shell side of the heat exchanger 50, it is within the ambit of the present invention to have the used catalyst passing through the tube side and the regenerated catalyst passing through the shell side. Moreover, although the FIG. 2 embodiment involves removing used catalyst from the downstream (lower) end of the stripper 22 for circulation through the heat exchanger 50 and return of heated used catalyst to an upstream (upper) end of the stripper, modes of used catalyst circulation from other regions of the stripper 22 fall within the ambit of the present invention. Thus, used catalyst can be removed from any region of the stripper 22 and, after circulation via the heat exchanger 50, can be returned to any region of the stripper, including the region from which the used catalyst is removed. For example, used catalyst may be returned from the heat exchanger 50 to a region of the stripper which is below the region from which it is removed for circulation to the heat exchanger.

COMPARATIVE EXAMPLES

The following Table of data shows temperatures (° C.) or average temperatures in the specified parts of an FCCU of the type shown in FIG. 1 and in the specified parts of an FCCU in accordance with FIG. 2.

TABLE

| FIG. No. | % Cat Circulation Regen. Cat Via Heat Exchanger | Regenerator Temp. | Reactor Temp. | Temp. of Regen. Cat Contacting Feed | Temp. of Used Cat Entering Regenerator | Stripper Temp. | Temp. of Used Cat Entering from Heat Exchanger |
|---|---|---|---|---|---|---|---|
| 1 | 0 | 704.4 | 523.9 | 704.4 | 523.9 | 523.9 | — |
| 2 | 15 | 704.4 | 523.9 | 676.7 | 551.7 | 551.7 | 579.4 |

Figure 3:
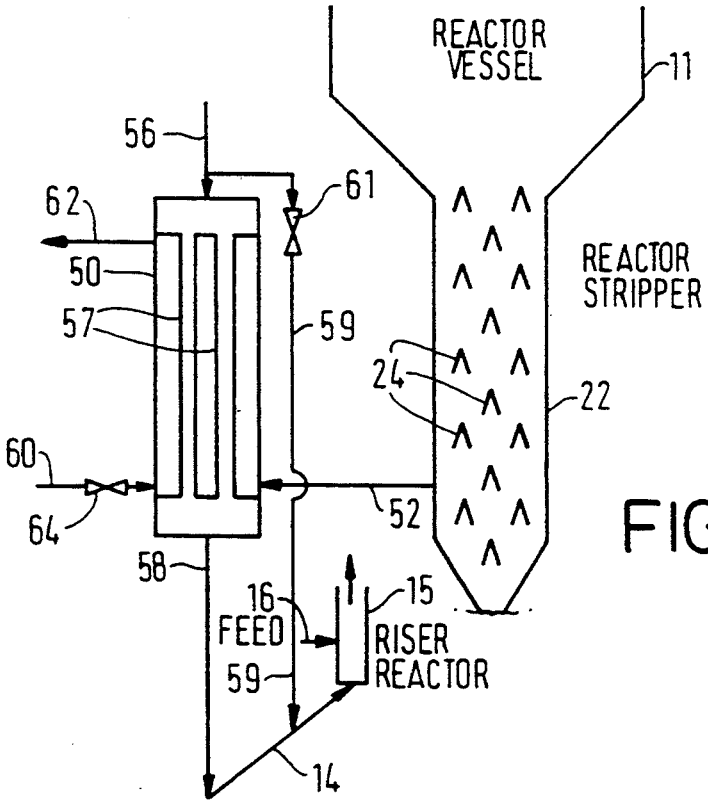
FIG. 3 shows some of the parts shown in FIG. 1 with adaptions in accordance with another embodiment of the invention.

Reference is now made to the embodiment of FIG. 3 of the drawings.

This embodiment is similar to that of FIG. 2 but differs in that instead of heated used catalyst being passed from the heat exchanger 50 to the stripper 22 (via line 54), the heated used catalyst is recovered from the heat exchanger 50 in line 62 and passed to the regenerator. The heated used catalyst is preferably passed via a cyclone separator system (not shown), e.g., of known type, to separate therefrom gases and vapours. The separated gases and vapours can be passed into the stripper 54 by a suitable pipe (not shown) for recovery with vaporous products in product line 20 (FIG. 1) and/or at least partly separately recovered in a product recovery line (not shown).

During operation of the embodiment of FIG. 3, a selected proportion of the used catalyst withdrawn via line 52 from the stripper is passed through the heat exchanger 50 in order to reduce the temperature of the hot regenerated catalyst contacting the oil feed from line 16 in the riser 15 to a temperature which is low enough to reduce the amount of thermal cracking of the oil relative to the amount of catalytic cracking and thereby reduce the production of by-product "coke" and gas. Suitably, up to 100% of the used catalyst circulation rate may be circulated via the heat exchanger, but for most operations, up to 40% is usually adequate, and for most operations, from 10 to 20%.

What is claimed is:

1. In a catalytic cracking process comprising the steps of contacting a hydrocarbon feed with particles of active hydrocarbon cracking catalyst under hydrocarbon-cracking conditions in a reaction zone, separately recovering from the reaction zone (a) vaporous cracked hydrocarbon products and (b) used catalyst particles, contacting the used catalyst particles with a stripping medium in a stripping zone to recover from the used catalyst particles hydrocarbon material associated therewith, passing stripped used catalyst particles from the stripping zone to a regeneration zone wherein the stripped used particles are contacted with an oxygen-containing gas to remove hydrocarbonaceous material associated therewith in a exothermic oxidation reaction which regenerates and heats the catalyst particles, and circulating the heated regenerated catalyst particles to the reaction zone for contact with further amounts of hydrocarbon feed; the improvement wherein (a) the hot regenerated catalyst particles from the dense catalyst phase of the regenerator are divided into a first portion and a remaining portion and the first portion is passed in dense phase flow in indirect heat exchange relationship in a heat exchanger external to the stripping zone with at least some used catalyst particles from the stripping zone before contacting hydrocarbon feed in the reaction zone whereby the temperature of the first portion of the regenerated catalyst particles is reduced and the temperature of the said used catalyst particles is increased and (b) the cooled first portion and the remaining portion of the regenerated catalyst particles are thereafter combined for contact with the feed.

2. In the process of claim 1, the improvement wherein the used catalyst particles from the stripping zone which are passed to the indirect heat exchange step are stripped used catalyst particles from one region of the stripping zone.

3. In the process of claim 1, the improvement wherein at least some heated used particles from the indirect heat exchange step are returned to an upstream region of the stripping zone.

4. In the process of claim 1, the improvement wherein the temperature of the heated used particles from the indirect heat exchange step is in the range of from 490° to 600° C.

5. In the process of claim 5, the improvement wherein the average or mean temperature of particles in the stripping zone is in the range of from 490° to 650° C.

6. In the process of claim 1, the improvement wherein the used catalyst particles and/or regenerated catalyst particles are maintained in a fluidized state while in the said indirect heat transfer relationship.

7. In the process of claim 6, the improvement wherein the used and/or regenerated catalyst particles are fluidized, during the said indirect heat exchange step, by a fluidizing gas containing steam and/or hydrogen and/or light hydrocarbons.

8. In the process of claim 7, the improvement wherein the fluidizing gas is separated and recovered from the catalyst particles after the said indirect heat exchange step.

9. In the process of claim 7, the improvement wherein the fluidizing gas is at a temperature of up to 600° C. before and/or during contact with catalyst particles in the said indirect heat exchange step.

10. In the process of claim 1, the improvement wherein at least a portion of the heated used catalyst particles from the indirect heat exchange step are passed directly to the regeneration zone.

11. In a catalytic cracking process comprising the steps of contacting a hydrocarbon feed with particles of active hydrocarbon cracking catalyst under hydrocarbon-cracking conditions in a reaction zone, separately recovering from the reaction zone (a) vaporous cracked hydrocarbon products and (b) used catalyst particles, contacting the used catalyst particles with a stripping medium in a stripping zone to recover from the used catalyst particles hydrocarbon material associated therewith, passing stripped used catalyst particles from the stripping zone to a regeneration zone wherein the stripped used particles are contacted with an oxygen-containing gas to remove hydrocarbonaceous material associated therewith in a exothermic oxidation reaction which regenerates and heats the catalyst particles, and circulating the heated regenerated catalyst particles to the reaction zone for contact with further amounts of hydrocarbon feed; the improvement wherein (a) at least some of the hot regenerated catalyst particles from the dense catalyst phase of the regenerator are passed in dense phase flow in indirect heat exchange relationship in a heat exchanger external to the stripping zone with at least some used catalyst particles from the stripping zone before contacting hydrocarbon feed in the reaction zone whereby the temperature of the regenerated catalyst particles is reduced and the temperature of the said used catalyst particles is increased and (b) at least some heated used catalyst particles from the indirect heat exchange step are returned to the stripping zone to increase the average or mean temperature of particles in the stripping zone, and any remaining heated used catalyst particles are passed to the regeneration zone.

* * * * *